US008384311B2

(12) United States Patent
Gray et al.

(10) Patent No.: US 8,384,311 B2
(45) Date of Patent: Feb. 26, 2013

(54) LIGHT EMITTING DIODE SELECTION CIRCUIT

(75) Inventors: Richard Landry Gray, Saratoga, CA (US); Po Ming Tsai, Taipei (TW)

(73) Assignee: Richard Landry Gray, Saratoga, CA (US)

( * ) Notice: Subject to any disclaimer, the term of this patent is extended or adjusted under 35 U.S.C. 154(b) by 282 days.

(21) Appl. No.: 12/903,150

(22) Filed: Oct. 12, 2010

(65) Prior Publication Data

US 2011/0084619 A1 Apr. 14, 2011

Related U.S. Application Data

(60) Provisional application No. 61/262,229, filed on Nov. 18, 2009, provisional application No. 61/251,489, filed on Oct. 14, 2009.

(51) Int. Cl.
*H05B 37/02* (2006.01)

(52) U.S. Cl. ..... 315/307; 315/185 R; 315/193

(58) Field of Classification Search ..... 315/185 R, 315/193, 209 R, 210, 226, 291, 294, 299, 315/302, 307

See application file for complete search history.

(56) References Cited

U.S. PATENT DOCUMENTS

| | | | | |
|---|---|---|---|---|
| 8,164,276 | B2 * | 4/2012 | Kuwabara | 315/294 |
| 2010/0164403 | A1 * | 7/2010 | Liu | 315/297 |
| 2010/0194299 | A1 * | 8/2010 | Ye et al. | 315/192 |
| 2010/0308739 | A1 * | 12/2010 | Shteynberg et al. | 315/193 |
| 2011/0068700 | A1 * | 3/2011 | Fan | 315/185 R |

* cited by examiner

*Primary Examiner* — Tung X Le

(57) ABSTRACT

The present invention relates to a Light Emitting Diode (LED) selection circuit for an LED driver that drives multiple unequal lengths of LED strings, which selectively turns the LED strings ON and OFF corresponding to an input alternating current (AC) line voltage. The LED driver provides optimal efficiency as input AC line voltage varies from low to high voltages (i.e. 90V to 150V for nominal 120 VAC operation and 190V to 250V for nominal 220 VAC operation). Thus The LED driver can be used internationally since it accepts voltages from virtually every industrialized country in the world. The LED selection circuit in accordance with the present invention comprises a rectifier, multiple LED strings, multiple current sources and a controller. The controller generates multiple signals to the corresponding current source and turns ON and OFF the LED strings.

11 Claims, 6 Drawing Sheets

LIGHT EMITTING DIODE SELECTION CIRCUIT

This application claims priority from provisional patents 61/262,229 and 61/251,489.

FIELD OF THE INVENTION

The present invention relates to a Light Emitting Diode (LED) driver, especially to an LED selection circuit for an LED driver to drive multiple unequal lengths of LED strings.

BACKGROUND OF THE INVENTION

White Light Emitting Diodes (WLEDs) hold much promise as the number one source of electric light in the future but their acceptance has been plagued by high costs, poor performance and poor reliability. WLED light solutions do exist now but they are priced outside the reach of most households and the product return rate remains stubbornly high.

For low cost applications some designers will try to drive a string of LED lamps directly across the Alternating Current (AC) mains using only a resistor as a ballast. While this strategy is indeed inexpensive it suffers from very low efficiency. The number of WLEDs in the string must be sized small enough so that the sum of all the forward voltage drops is less than the peak AC drive signal, otherwise current will never flow through the diodes and the diodes will never provide any light. If the forward voltage of all the diodes is much less than the peak AC drive voltage then a large amount of power will be dissipated across the ballast resistor and the efficiency of the lamp will be greatly reduced.

If the forward voltage of all the diodes is close to the peak AC voltage then the efficiency will improve but the power factor will degrade. Also, as the AC drive signal changes from high line conditions to low line conditions the amount of current through the diode string changes as will the light output. The current may change enough to put it outside the safe operating range of the diode which will, at the very least, degrade the diode as well as create high temperatures subsequently lowering the life of the WLED string.

SUMMARY OF THE INVENTION

An objective of the present invention is to provide a Light Emitting Diode (LED) selection circuit for an LED driver to drive multiple unequal lengths of LED strings, which selectively and respectively turns the LED strings ON and OFF corresponding to an input alternating current (AC) line voltage.

The LED selection circuit in accordance with the present invention comprises a rectifier, multiple LED strings, multiple current sources and a controller. The rectifier converts an input AC line voltage to a pulsating direct current (DC) voltage. Each of the multiple current sources corresponds to a particular LED string or to a particular position along a single LED string. The controller generates multiple signals to the corresponding current source and sequentially turns ON and OFF the LED strings in order to follow a waveform of input AC line voltage. Besides turning the LED strings ON and OFF, the controller also has the ability to adjust how much current will flow through the current sources.

Another objective of the present invention is to provide a circuit for an LED driver to accept voltages of the input AC line voltage from 90 VAC to 240 VAC and frequencies between 50-60 Hz. The LED selection circuit in accordance with the present invention provides optimal efficiency as input AC line voltage varies from lower to higher voltages (i.e. 90V to 150V for nominal 120 VAC operation and 190V to 250V for nominal 240 VAC operation). The LED driver can be used internationally since it accepts voltages from virtually every industrialized country in the world.

According to one embodiment, an LED selection circuit in accordance with the present invention comprises a rectifier, a first LED string, a second LED string, at least two current sources, a high voltage (HV) diode, a PMOS module, a peak sensing module, a first NMOS transistor, a second NMOS transistor and a controller.

The controller turns the first NMOS transistor OFF and the second NMOS transistor ON when the input AC line voltage is near 120 VAC. The PMOS module causes the HV diode to block current flow from the first LED string to the second LED string, thus the first LED string and the second LED string are configured in parallel. The controller turns the first NMOS transistor ON and the second NMOS transistor OFF when the input AC line voltage is near 240 VAC. The PMOS module causes the HV diode to be forward biased, thus configuring first LED string and the second LED string in series.

According to another embodiment, the PMOS module, the first NMOS transistor and the second NMOS transistor have been replaced with an NMOS module. The NMOS module comprises a switching component, a third NMOS transistor, a fourth NMOS transistor, a capacitor, a blocking diode, a dummy resistor and a voltage source. The controller determines current through a first feedback resistor, and turns the third NMOS transistor and the fourth NMOS transistor ON or OFF in order to configure the first LED string and the second LED string being connected in parallel or in series.

BRIEF DESCRIPTIONS OF THE DRAWINGS

Figure 4:
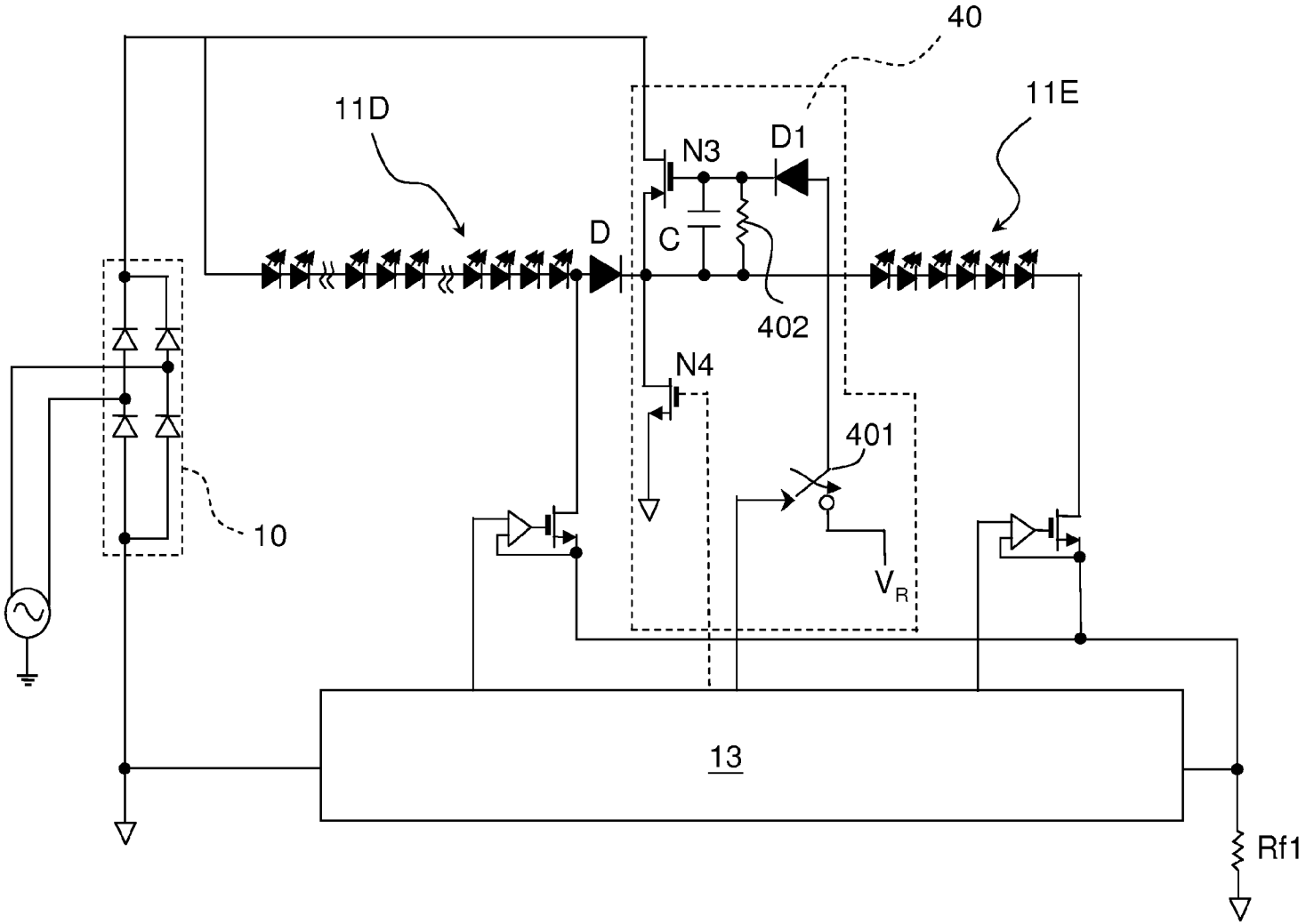
FIG. 4 is a circuit diagram illustrating another embodiment of an LED selection circuit that allows for switching between 120 VAC and 240 VAC operation.
Figure 5:
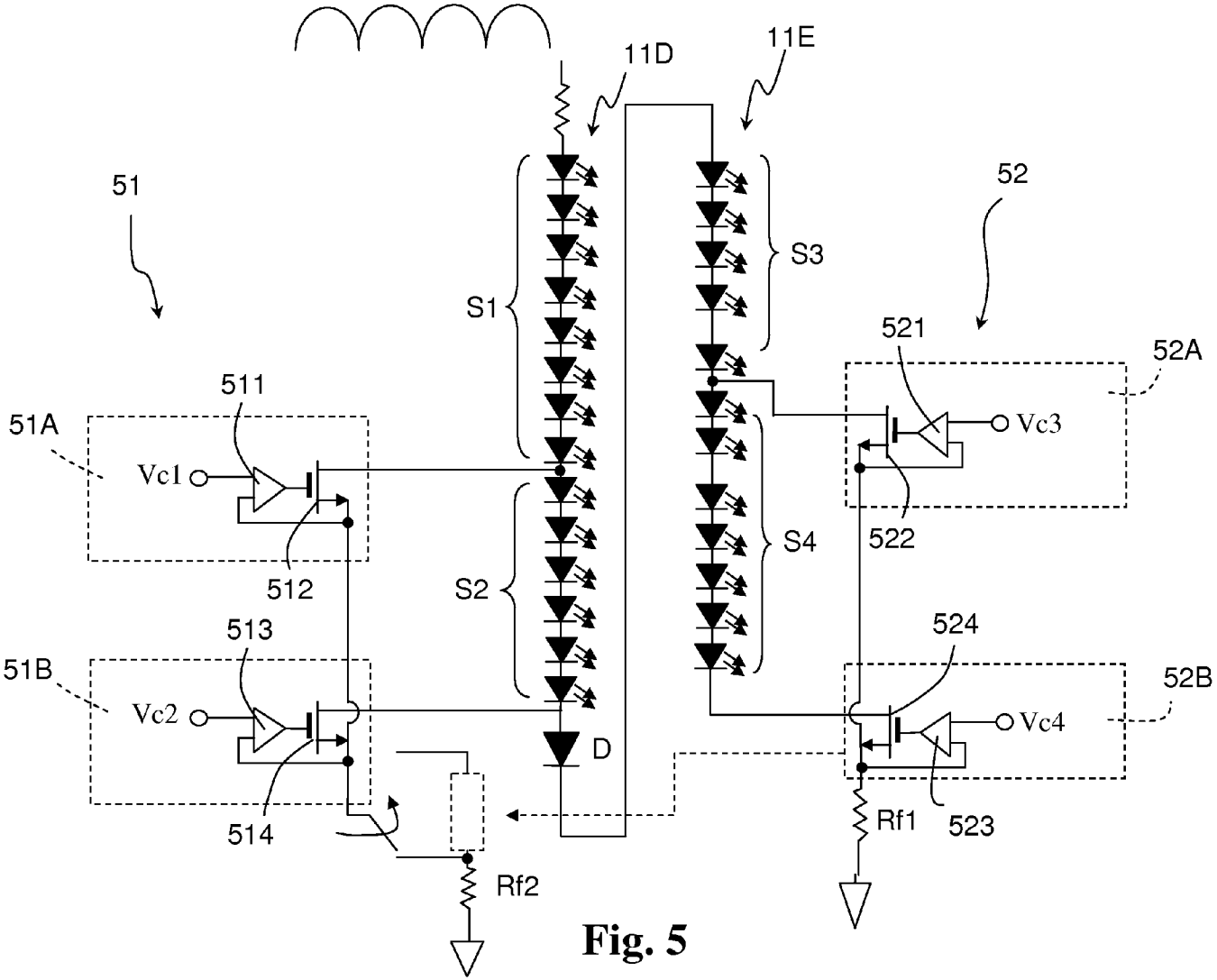

FIG. 5 a partial circuit diagram illustrating an embodiment of using at least one dividing current module to the LED string of FIG. 4.

DETAILED DESCRIPTION OF THE PRESENT INVENTION

Figure 1:
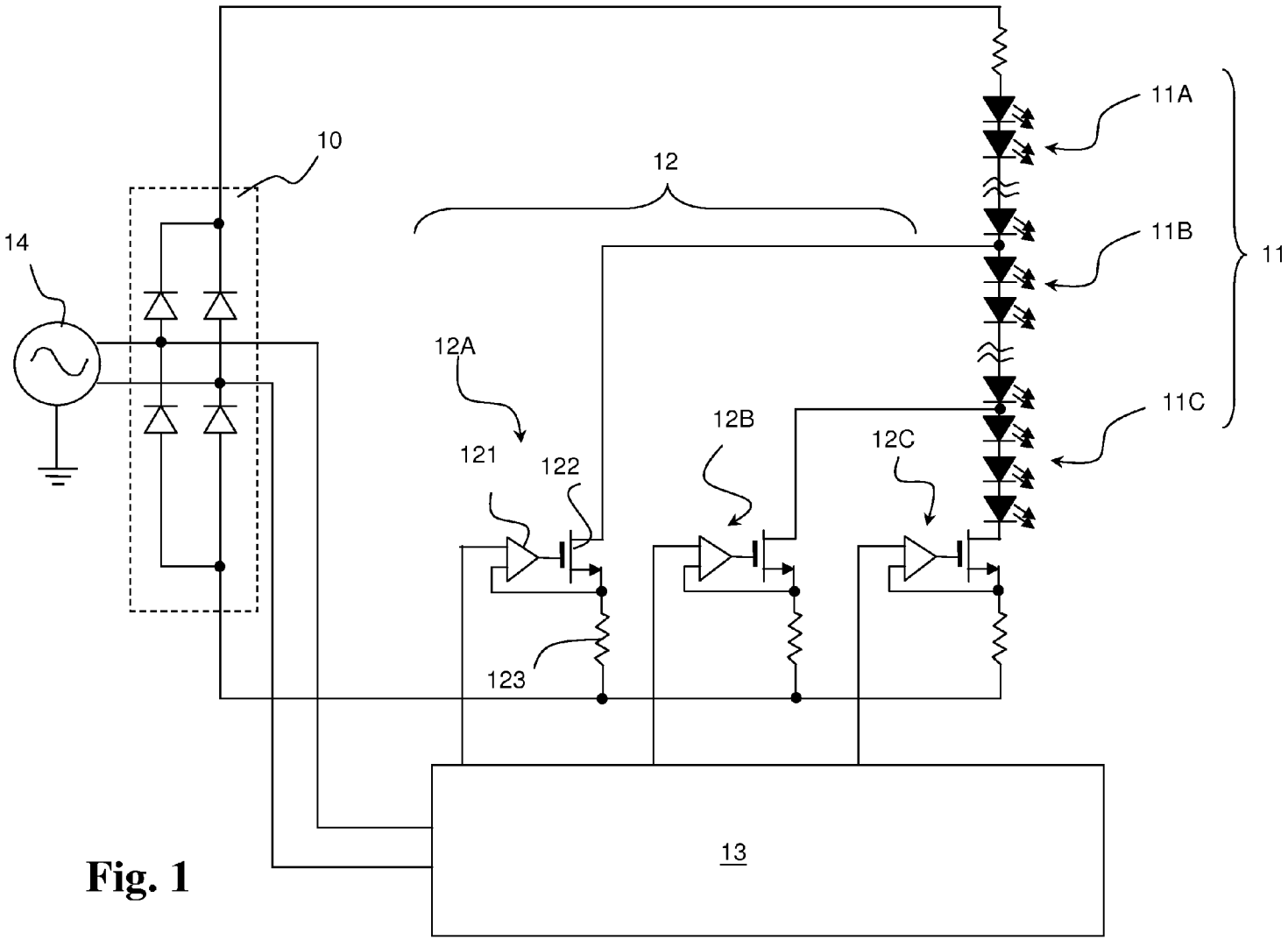
FIG. 1 is a circuit diagram illustrating an embodiment of a Light Emitting Diode (LED) selection circuit of the present invention.

With reference to FIG. 1, a first embodiment of a Light Emitting Diode (LED) selection circuit of an LED driver that drives multiple unequal lengths of LED strings an LED to selectively turn the LED strings ON or OFF corresponding to an input alternating current (AC) line voltage.

In this embodiment, the LED selection circuit in accordance with the present invention comprises a rectifier (10), multiple LED strings (11), multiple current sources (12) and a controller (13).

The rectifier (10) is connected to an AC power source (14) and converts an input AC line voltage to a pulsating direct current (DC) voltage.

The multiple LED strings (11) may comprise a first LED string (11A), a second LED string (11B) and a third LED string (11C). The multiple current sources (12) correspond to the LED strings (11) and may comprise a first current source (12A), a second current source (12B) and a third current source (12C). However, people skilled in art will know the numbers of LED strings (11) and the current sources (12) can be changed to comply with needs. Each of the current sources (12) comprises an error amplifier (121) and a transistor (122). The error amplifier (121) has a first input end, a second input end and an output end. The first input end of the error amplifier (121) is connected to the controller (13). The transistor (122) has a drain, a source and a gate. The drain of the transistor (122) is connected to a position along LED string (11) which could include a bottom side of the LED string (11). The source of the transistor (122) is connected to the second input end of the error amplifier (121) and a current sensing resistor (123). The gate of the transistor (122) is connected to the output end of the error amplifier (121). To people skilled in the art it will be apparent that the current source defined by the error amplifier (121), the transistor (122), and the current sensing resistor (123) could be implemented in various ways. The method shown here is a reasonable means of configuring the required current source but is not intended to imply and limit that this is the only method available.

The controller (13) is connected to the rectifier (10) and the current sources (12), synchronizes frequencies and phases of the pulsating DC voltage, and generates multiple reference voltages to the corresponding current sources (12) at appropriate times. The reference voltages are predefined to set current flow through the corresponding LED strings (11) when enough driving voltage is available to forward bias that particular section of the LED string (11), and thus can be turned ON and OFF in order that the current through the LED strings (11) follow a waveform of the input AC line voltage.

The appropriate times are determined by counting evenly spaced clock cycles that are synchronized to the input voltage half wave cycle. The evenly spaced clock cycles are produced by a Phase Locked Loop (PLL) circuit synchronized to the input voltage half wave cycle. The detailed implementation may refer to Patent Cooperation Treaty (PCT) patent application No. WO2009148789 and U.S. patent application Ser. No. 12/820,131. The referenced patent applications are filed by same applicant of the present invention.

It should be noted that the "appropriate times" mentioned in the previous paragraph does not necessarily mean exclusively following the input AC line voltage at all times. If the current through the LED string always follows the input AC line voltage then the brightness of the LED string will modulate up and down at twice the frequency of input AC line voltage. This would result in 120 Hz flicker for 60 Hz line frequencies and 100 Hz flicker for 50 Hz line frequency. In order to avoid that type of operation the controller (13) can turn the LED string (11) OFF at any time during the input half wave cycle in order to modulate the brightness of the LED string (11) at frequencies much higher than twice the input AC line voltage frequency. For instance, by turning off the LED string (11) for some duration during the peak of the half wave cycle the effective brightness modulation frequency become four times the line frequency. That implies a brightness modulation frequency of 200 Hz for a 50 Hz input AC line voltage. 200 Hz is higher than the 150 Hz limit that is commonly used as the minimum modulation frequency that is unable to be detected by human beings.

Figure 2:
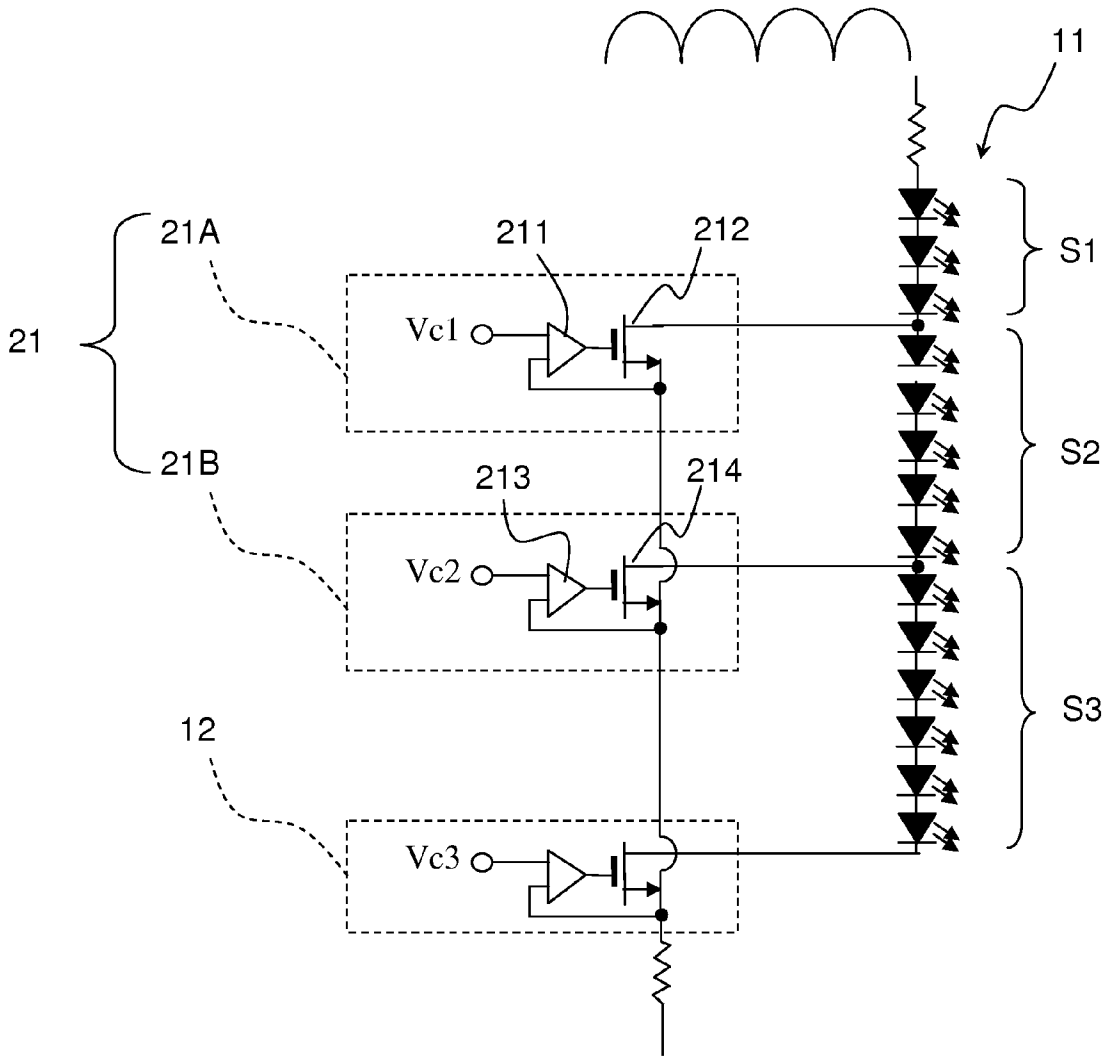
FIG. 2 is a partial circuit diagram illustrating an embodiment of using at least one dividing current source to the LED string of FIG. 1.

With reference to FIG. 2, a second embodiment of the LED selection circuit drives multiple unequal lengths of LED strings of an LED driver. The difference between the first and second embodiment is that the LED strings of the first embodiment are "actively" being turned ON and OFF sequentially by the controller. The LED strings of the second embodiment are "automatically (passively)" turned ON and OFF to follow a waveform of the input AC line voltage. The automatic ON and OFF control of the different LED segments is still easily overridden by the controller (13) in order to provide brightness modulation at frequencies higher than twice the input AC voltage frequency.

The LED selection circuit of the second embodiment of the FIG. 2 uses the same circuit scheme as mentioned in FIG. 1, which further comprises at least one dividing current source (21) for dividing each of LED strings (11) into multiple segments (i.e. first, second and third segment (S1, S2, S3)) respectively. In this embodiment the dividing current source (21) comprises, but is not limited to, a first dividing current source (21A) and a second dividing current source (21B). The first dividing current source (21A) is connected to the LED string (11) and the current source (12), and comprises a first dividing error amplifier (211) and a first dividing transistor (212). The second dividing current source (21B) is connected to the first dividing current source (21A), the current source (12) and the LED string (11), and comprises a second dividing error amplifier (213) and a second dividing transistor (214).

The first dividing error amplifier (211) comprises a first input end, a second input end and an output end. The first dividing transistor (212) comprises a drain, a source and a gate. The drain of the first dividing transistor is connected between the first and second segment (S1, S2) of the LED strings (11). The gate is connected to the output end of the first dividing error amplifier (211). The source is connected to the second input end of the first dividing error amplifier (211).

The second dividing error amplifier (213) comprises a first input end, a second input end and an output end. The second dividing transistor (214) comprises a drain, a source and a gate. The drain is connected between the second LED segment and the third LED segment (S2, S3). The gate is connected to the output end of the second dividing error amplifier (213). The source is connected to the second input end of the second dividing error amplifier (213), the first dividing current source (21A) and the current sensing resistor (123).

The sources of all the dividing transistors are connected in common.

The controller (13) provides multiple predetermined reference voltages (Vc1, Vc2, Vc3) that set current levels of the corresponding dividing current sources (i.e. the first and second dividing current source (21A, 21B)) and the current source (12). The current level of the first dividing current source (21A) is lower than the second dividing current source (21B), the current level of the second dividing current source (21B) is lower than the current source (12).

As the input AC line voltage increases, the first dividing current source (21A) turns the first segment (S1) LED (11) ON first. Other current sources (21B, 12) cannot sink any current because there is not enough voltage across their respective segments (S2, S3) of the LED string (11) to support any current flow. As the input AC line voltage further increases, the second segment (S2) gets enough voltage to conduct current. Since the first, second dividing current source (21A, 21B) and the current source (12) are connected to the same current sensing resistor, and the value of the reference voltage (Vc2) is larger than the reference voltage (Vc1), this has the effect of turning OFF the first dividing current source (21A) while the second current source (21B) ends up sinking the current though the first and second segments (S1, S2). As the input AC line voltage further increases successive current sources (i.e. the first dividing current source (21A) to the second dividing current source (21B)) conduct until the last current source (i.e. the current source (12)) conducts. Eventually the input AC line voltage reaches its peak voltage and proceeds to decrease in value, which repeats the process in reverse.

This second embodiment has two important advantages. First, because each succeeding current source has a higher current level than the preceding current source, the input current waveform increases and decreases as the input AC line voltage does, and thus provides natural power factor correction. Second, each segment turns ON at its most optimally efficient point along the waveform of the input AC line voltage.

Figure 3A:
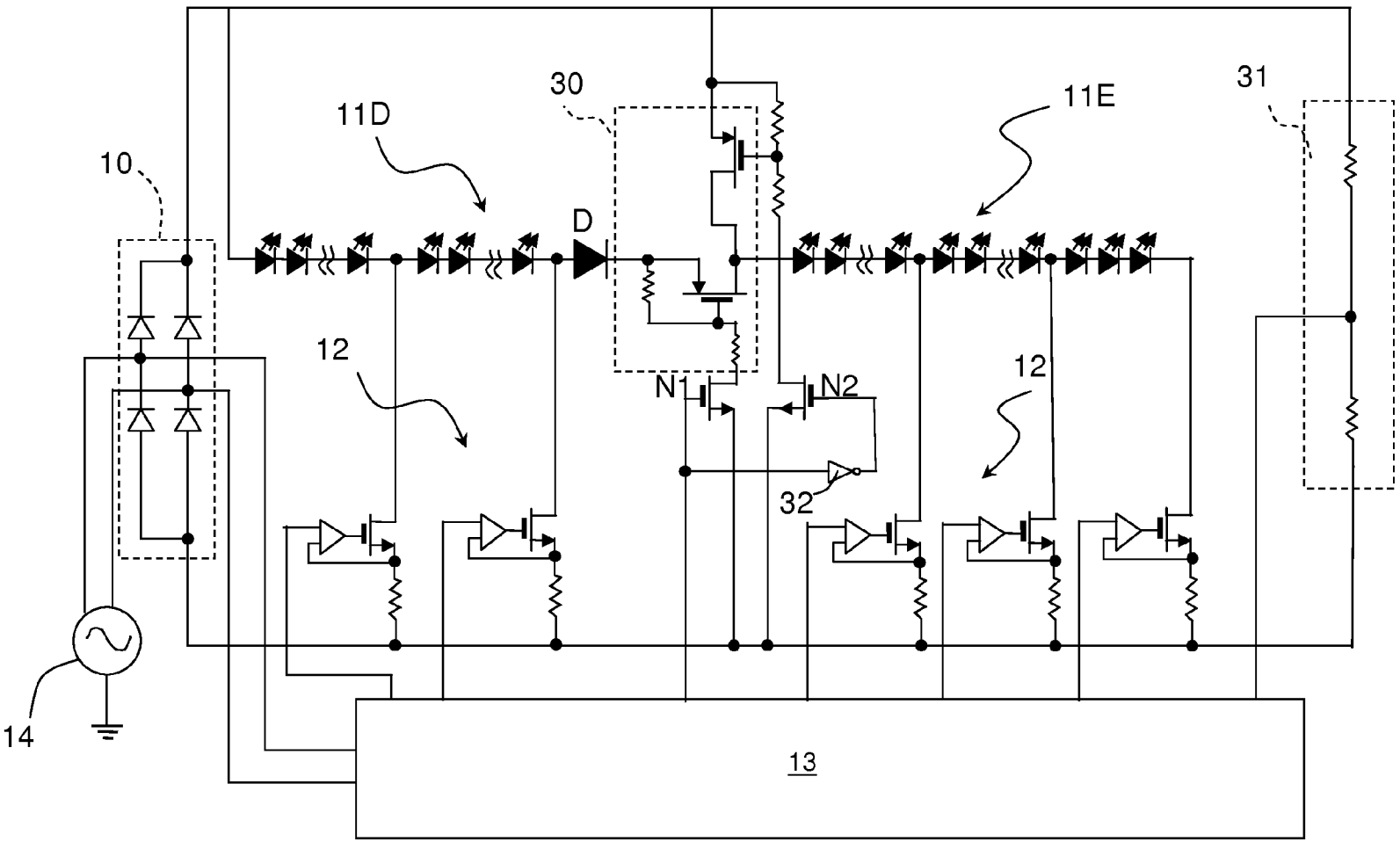
FIG. 3A is a circuit diagram illustrating an embodiment of an LED selection circuit that allows for switching between 120 VAC and 240 VAC operation of an LED driver in accordance with the present invention.
Figure 3B:
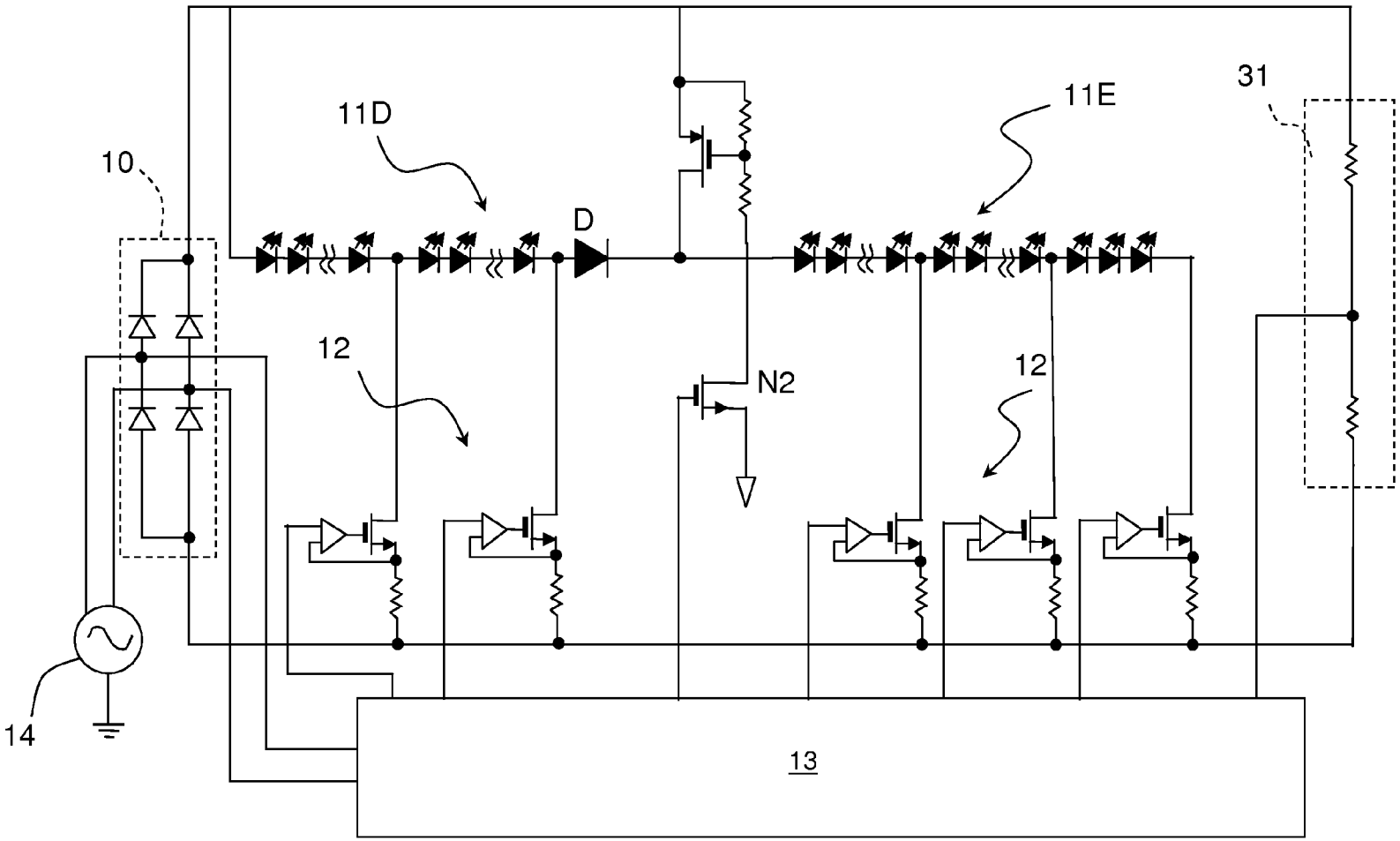
FIG. 3B is a circuit diagram illustrating another embodiment of an LED selection circuit that allows for switching between 120 VAC and 240 VAC operation.

With reference to FIGS. 1, 3A and 3B, a third embodiment of the LED selection circuit allows for reconfiguring the LED strings for 120 VAC or 240 VAC operation. The LED selection circuit of the third embodiment comprises a rectifier (10), multiple LED strings (11), multiple current sources (12), a controller (13) a high voltage (HV) diode (D), a PMOS module (30), a peak sensing module (31), a optional first NMOS transistor (N1) and a second NMOS transistor (N2).

The HV diode (D) is coupled between the fourth LED string (11D) and the fifth LED string (11E) and has a cathode and an anode. The anode of the HV diode (D) is connected to the fourth LED string (11D). The cathode of the HV diode (D) is connected to the PMOS module (30). The PMOS module (30) is connected to the rectifier (10) and to the fifth LED string (11E).

The peak sensing module (31) is connected to the rectifier (10), is a resistor divider network that comprises two resistors, which provides peak information of the pulsating DC voltage to the controller (13), so the controller (13) can determine if the input AC line voltage is within the 120 VAC or 240 VAC range. The first NMOS transistor (N1) and the second NMOS transistor (N2) are connected to the PMOS module (30) and an inverter is connected between the gates of the first NMOS transistor (N1) and the second NMOS transistor (N2). The inverter has an input that is connected to the controller (13) (shown in FIG. 3A). Drains of the first and the second NMOS transistors (N1, N2) are connected to the PMOS module (30) and the sources of the first and the second NMOS transistors (N1, N2) are tied to a common ground.

However, the second NMOS transistor (N2) can be stand alone (shown in FIG. 3B) where it is also controlled by the controller (13). To people skilled in the art it will be apparent that the circuit implementations of FIGS. 3A and 3B perform similar functions.

The controller (13) turns the second NMOS transistor (N2) ON (simultaneously the first NMOS transistor (N1) OFF) when the input AC line voltage is in 120 VAC operation range. The PMOS module (30) causes the HV diode (D) to block current flow from the fourth LED string (11D) to the fifth LED string (11E) by connecting the fifth LED string (11E) to the rectifier (10), and thus the fourth LED string (11D) and the fifth LED string (11E) are configured in parallel.

The controller (13) turns the second NMOS transistor (N2) OFF (simultaneously the first NMOS transistor (N1) ON) when the input AC line voltage is 240 VAC. The PMOS module (30) allows the HV diode (D) to become forward biased and configures the fourth LED string (11D) and the fifth LED string (11E) in series.

With reference to FIG. 4, a fourth embodiment of an LED selection circuit that allows for switching the LED strings turning ON and OFF between 120 VAC and 240 VAC operation of an LED driver using the same circuit scheme as mentioned in FIGS. 1, 3A and 3B. The difference between the embodiments in FIGS. 3 and 4 is that the embodiment of the LED selection circuit shown in FIG. 4 does not use of the resistor divider network to sense a peak input AC voltage, and the PMOS module (30), the first NMOS transistor (N1) and the second NMOS transistor (N2) have been replaced with an NMOS module (40).

In this embodiment, the fourth LED string (11D) and the fifth LED string (11E) are connected in series as default. The controller (13) determines current passed through a first feedback resistor (Rf1) that indicates a desired current has been achieved when the fourth LED string (11D) and the fifth LED string (11E) are connected in series. If current passed through the first feedback resistor (Rf1) is not able to provide the desired current that indicates the voltage of the pulsating DC voltage is lower than a voltage required to turn the fourth LED string (11D) and the fifth LED string (11E) ON. In this case, the controller (13) reconfigures the fourth LED string (11D) and the fifth LED string (11E) in parallel, and thus the fourth LED string (11D) and the fifth LED string (11E) can be turned ON because the required voltage (voltage drop across the first and the second LED string) has been decreased.

This concept can be extended so that the peak input AC voltage can be sensed to a finer resolution by turning on different LED strings of diodes in succession. If the current through the first feedback resistor (Rf1) for the next LED string cannot provide the desired current then the current source for the next LED string is turned ON. This can be repeated as many times as needed.

The NMOS module (40) comprises a switching component (401), a third NMOS transistor (N3), a fourth NMOS transistor (N4), a capacitor (C), a blocking diode (D1), a resistor (402) and a voltage source ($V_R$).

The third NMOS transistor (N3) comprises a drain, a source and a gate. The gate of the third NMOS transistor (N3) is coupled to the switching component (401) through diode D1. The source of the third NMOS transistor (N3) is connected to a cathode end of a HV diode (D). The drain of the third NMOS transistor (N3) is connected to a rectifier (10). The capacitor (C) and the resistor (402) are connected in parallel between the gate and the source of the third NMOS transistor (N3). The voltage source ($V_R$) is coupled to the gate of the third NMOS transistor (N3) through the switching component (401) and the blocking diode (D1). The fourth NMOS transistor (N4) comprises a drain, a source and a gate. The gate of the fourth NMOS transistor (N4) is connected to controller (13). The drain of the fourth NMOS transistor (N4) is connected to the source of the third NMOS transistor (N3).

One improvement of the embodiment illustrated in FIG. 4 over that shown in FIGS. 3A and 3B is due to the third NMOS transistor (N3) whose gate voltage can be pumped higher than the input AC line voltage since the input voltage is a half-wave sinusoid and approaches 0 volts twice each cycle, thus replacing the PMOS module (30) in FIG. 3A. The PMOS components in the PMOS module (30) are more expensive and perform less efficiently than comparable NMOS components in the NMOS module (40). In the case of low input AC line voltage (i.e. 120 VAC) where the LED strings (11D, 11E) are configured as two parallel strings, the voltage source ($V_R$) is connected to the blocking diode (D1), which is in turn connected to the gate of the third NMOS transistor (N3). When the source of the third NMOS transistor (N3) is close to zero volts, the gate of the third NMOS transistor (N3) will be turned ON and the charge on the gate will remain there until discharged by the resistor (402) from gate to source of the third NMOS transistor (N3). The third NMOS transistor (N3) will remain on even as the drain (and source) voltage of the third NMOS transistor (N3) increases up to the peak voltage of the pulsating DC voltage.

The fourth NMOS transistor (N4) is added in order to pull down the source of the third NMOS transistor (N3), the fourth NMOS transistor (N4) should be momentarily pulsed on when the pulsating DC voltage approaches zero volts, that will ensure that the gate of the third NMOS transistor (N3) is properly charged.

With reference to FIG. 5, a fifth embodiment of an LED selection circuit allows for switching between 120 VAC and 240 VAC operation of an LED driver using the same circuit scheme as mentioned in FIGS. 2 and 4 (the actual 120 VAC to 240 VAC switching circuitry is not shown in this drawing). Although the third and fourth embodiments provide switching one series string into 2 parallel strings, which is quite effective for large line voltage variations, it still does not provide optimal efficiency as the input AC line voltage varies from low line conditions to high line values, i.e., 90 volts to 150 volts for nominal 120 VAC operation and 190 volts to 250 volts for nominal 220 VAC line voltages.

The fifth embodiment of the LED selection circuit further comprise a first dividing module (51), a second dividing module (52), an HV diode (D), a first feedback resistor (Rf1) and a second feedback resistor (Rf2). The first dividing module (51) is connected to the fourth LED string (11D) and divides the fourth LED string (11D) to a first segment (S1) and a second segment (S2). The second dividing module (52) is connected to the fifth LED string (11E) and divides the fifth LED string (11E) into a third segment (S3) and a fourth segment (S4). The first dividing module (51) comprises a first dividing current source (51A) and a second dividing current source (51B). The second dividing module (52) comprises a third dividing current source (52A) and a fourth dividing current source (52B).

The first dividing current source (51A) comprises a first error amplifier (511) and a first transistor (512). The first error amplifier (511) has a first input end, a second input end and an output end. The first input end receives a first current level voltage. The first transistor (512) comprises a drain, a source and a gate. The drain of the first transistor (512) is connected between the first segment (S1) and the second segment (S2). The source of the first transistor (512) is connected to the second input end of the first error amplifier (511). The gate of the first transistor (512) is connected to the output end of the first error amplifier (511).

The second dividing current source (51B) comprises a second error amplifier (513) and a second transistor (514). The third dividing current source (52A) comprises a third error amplifier (521) and a third transistor (522). The fourth dividing current source (52B) comprises a fourth error amplifier (523) and a fourth transistor (524). Each of the first, second, third and fourth transistors (512, 514, 522, 524) has a drain, a source and a gate, respectively.

The second, third and fourth dividing current sources (51B, 52A, 52B) are all constructed identically to the first dividing current source (51A). The sources of the first dividing current source (51A) and the second dividing current source (51B) are connected together. The sources of the third dividing current source (52A) and the fourth dividing current source (52B) are connected together. The drain of the second dividing current source (51B) is connected between the second segment (S2) and the HV diode (D). The drain of the third dividing current source (52A) is connected between the third segment (S3) and the fourth segment (S4). The drain of the fourth dividing current source (52B) is connected to the fourth segment (S4).

The threshold voltages (Vc1, Vc2, Vc3, Vc4) that set the current levels in the individual current sources are generated by the controller (not shown), and each succeeding current source has been set to a lower current level than the preceding current source, which has been described previously in the second embodiment.

In parallel operation the first current dividing module (51) uses a feedback voltage from the second feedback resistor (Rf2), the second current dividing module (52) uses a feedback voltage from feedback resistor (Rf1). In series operation the first current dividing module (51) uses the sum of a feedback voltage across the first feedback resistor (Rf1) and the second feedback resistor (Rf2). In this situation when the first current dividing module (51) is operating then the voltage across the first feedback resistor (Rf1) is zero; in effect the first current dividing module (51) just sees the effect of the second feedback resistor (Rf2) during this time.

However, when the LED selection circuit needs to switch operation from series to parallel, the first current dividing module (51) see the sum of the feedback voltage across the first feedback resistor (Rf1) and the second feedback resistor (Rf2). This leads to a smooth, spike-free transition as the LED string current shifts from the first current dividing module (51) to the second current dividing module (52) because of the natural progression of the pulsating DC voltage.

People skilled in the art will understand that various changes, modifications and alterations in form and details may be made without departing from the spirit and scope of the invention.

What is claimed is:

1. A Light Emitting Diode (LED) selection circuit comprising:

a rectifier converting an input Alternating Current (AC) line voltage to a pulsating Direct Current (DC) voltage;

multiple LED strings;

multiple current sources, each current source comprising an error amplifier having a first input end, a second input end and an output end; and a transistor having a drain, a source and a gate, the drain of the transistor being connected to a bottom side of the corresponding LED string, the source of the transistor being connected to the second input end of the error amplifier and one end of a current sensing resistor, the gate of the transistor being connected to the output end of the error amplifier, wherein another end of the current sensing resistor is connected to the rectifier; and a controller being connected to the rectifier and the current sources and turning ON and OFF the corresponding LED strings, wherein the controller synchronizes frequencies of the pulsating DC voltage and generates multiple reference voltages to the corresponding current sources at an appropriate time.

2. The LED selection circuit as claimed in claim wherein the controller turns OFF the current in the LED string at least one time during a half wave cycle so that the LED brightness modulation frequency being higher than twice the AC input line voltage.

3. The LED selection circuit as claimed in claim 1, further comprising at least one dividing current source dividing each of the LED strings into multiple segments respectively, and comprising the first dividing current source being connected to the LED string and the current source, and the LED string being divided to a first segment and a second segment; and the second dividing current source being connected to the LED string, the first dividing current source and the current source, and the LED string being divided into a third segment; and wherein the reference voltage provided by the controller comprises multiple preset voltages indicative of a specific current level respectively to the first dividing current source, the second dividing current source and the current source, which the preset voltage provided to the first dividing current source is lower than the preset voltage provided to the second dividing current source, the preset voltage provided to the second dividing current source is lower than the preset voltage provided to the current source.

4. The LED selection circuit as claimed in claim 3, wherein the first dividing current source comprises a first dividing error amplifier comprising a first input end, a second input end and an output end; and a first transistor comprising a drain being connected to the first segment;

a source being connected to the second input end of the first error amplifier; and a gate being connected to the output end of the first error amplifier; and the second dividing current source comprises a second dividing error amplifier comprising a first input end, a second input end and an output end; and a second transistor comprising a drain being connected to the second segment;

a gate being connected to the output end of the second error amplifier; and a source being connected to the second input end of the second error amplifier, the first dividing current source and the current sensing resistor.

5. An LED selection circuit, for switching between 120 Volts, Alternating Current (VAC) and 240 VAC operation of an LED driver, comprising a rectifier converting an input AC line voltage to a pulsating DC voltage;

multiple LED strings comprising a first LED string and a second LED string;

multiple current sources, each current source comprising an error amplifier having a first input end, a second input end and an output end; and a transistor having a drain, a source and a gate, the drain of the transistor being connected to a bottom side of the corresponding LED string, the source of the transistor being connected to the second input end of the error amplifier and a current sensing resistor, the gate of the transistor being connected to the output end of the error amplifier;

a high voltage (HV) diode being coupled between the first LED string and the second LED string, wherein an anode of the HV diode is connected to the first LED string;

a PMOS module being connected to the rectifier, the second LED string and a cathode of the HV diode;

a peak sensing module being connected to the rectifier and sensing peak information of the pulsating DC voltage;

a second NMOS transistor; and a controller receiving the peak information from the peak sensing module, and turning the second NMOS transistor to configure the first LED string and the second LED string being connected in parallel or in series.

6. The LED selection circuit as claimed in claim 5, further comprising a first NMOS transistor and an inverter is connected between gates of the first NMOS transistor and the second NMOS transistor, the drains of the first the second NMOS transistor are connected to the PMOS module and the sources are tied to a common ground.

7. The LED selection circuit as claimed in claim 5, wherein the controller turns the second NMOS transistor ON when the input AC line voltage is in 120 VAC voltage range, the PMOS module causes the HV diode to block current flow from the first LED string to the second LED string, and thus the first LED string and the second LED string are configured in parallel.

8. The LED selection circuit as claimed in claim 5, wherein the controller turns the second NMOS transistor OFF when the input AC line voltage is in 240 VAC voltage range, the PMOS module allows the HV diode to become forward biased and configures first LED string and the second LED string in series.

9. An LED selection circuit, for switching between 120 VAC and 240 VAC operation of an LED driver, comprising a rectifier converting an input AC line voltage to a pulsating DC voltage;

multiple LED strings comprising a first LED string and a second LED string, wherein the first LED string and the second LED string are connected in series as default;

multiple current sources, each current source comprising an error amplifier having a first input end, a second input end and an output end; and a transistor having a drain, a source and a gate, the drain of the transistor being connected to a bottom side of the corresponding LED string, the source of the transistor being connected to the second input end of the error amplifier, the gate of the transistor being connected to the output end of the error amplifier;

a high voltage (HV) diode being coupled between the first LED string and the second LED string, wherein an anode of the HV diode is connected to the first LED;

a NMOS module comprising a switching component;

a third NMOS transistor comprising a gate being coupled to the switching component;

a source being connected to a cathode end of the HV diode; and a drain being connected to the rectifier; and a capacitor;

a blocking diode;

a resistor, the capacitor and the resistor are parallel connected between the gate and the source of the third NMOS transistor;

a voltage source being coupled to the gate of the third NMOS transistor through the switching component and the blocking diode; and a fourth NMOS transistor comprising a gate being coupled to the controller; and a drain being connected to the source of the third NMOS transistor; and a controller determining current through a first feedback resistor, and turning the third NMOS transistor and the fourth NMOS transistor to configure the first LED string and the second LED string being connected in parallel or in series.

10. The LED selection circuit as claimed in claim 9, further comprising a second feedback resistor;

a first dividing module being connected to the first LED string and dividing the first LED string to a first segment and a second segment;

a second dividing module being connected to the second LED string and dividing the second LED string to a third segment and a fourth segment; and wherein, the first current dividing module uses a feedback voltage from the second feedback resistor in parallel operation, and uses the sum of a feedback voltage across the first feedback resistor and the second feedback resistor in series operation.

11. The LED selection circuit as claimed in claim 10, wherein the first dividing module comprises a first dividing current source receiving a first preset voltage level indicative of a current in the current source and being connected between the first segment and the second segment of the first LED string; and a second dividing current source receiving a second preset voltage level indicative of a current in the current source and being connected between the second segment and the anode of the HV diode; and the second dividing module comprises a third dividing current source receiving a third preset voltage level indicative of a current in the current source and being connected between the third segment and the fourth segment of the second LED string; and a fourth dividing current source receiving a fourth preset voltage level indicative of a current in the current source and being connected to the fourth segment of the second LED string and the first feedback resistor.

* * * * *